United States Patent [19]

Fukada

[11] Patent Number: 4,525,893

[45] Date of Patent: Jul. 2, 1985

[54] CURTAIN RUNNER

[75] Inventor: Hiroo Fukada, Tokyo, Japan

[73] Assignee: Toso Kabushiki Kaisha, Tokyo, Japan

[21] Appl. No.: 532,569

[22] Filed: Sep. 15, 1983

[30] Foreign Application Priority Data

Sep. 16, 1982 [JP] Japan ..... 57-138927

[51] Int. Cl.[3] ..... A47H 15/00

[52] U.S. Cl. ..... 16/102; 16/97; 16/105; 104/108; 105/154

[58] Field of Search ..... 16/102, 93 D, 105, 87.2, 16/87.4 R, 91, 97; 104/107, 108, 109, 94; 105/156, 154, 155; 49/409–412

[56] References Cited

U.S. PATENT DOCUMENTS

| | | | |
|---|---|---|---|
| 839,621 | 12/1906 | Myers | 16/105 |
| 2,446,887 | 8/1948 | Shearer | 16/97 |
| 2,783,493 | 3/1957 | Gussack | 16/97 |
| 2,909,802 | 10/1959 | Gang et al. | 49/411 |
| 3,251,400 | 5/1966 | Krull | 16/93 D |
| 3,813,728 | 6/1974 | Johnson | 16/105 |
| 4,047,262 | 9/1977 | Izawa | 16/93 D |
| 4,408,369 | 10/1983 | Labelle | 16/102 |

FOREIGN PATENT DOCUMENTS

| | | | |
|---|---|---|---|
| 219491 | 6/1961 | Austria | 105/156 |

*Primary Examiner*—Donald R. Schran
*Assistant Examiner*—James Wolfe
*Attorney, Agent, or Firm*—Birch, Stewart, Kolasch & Birch

[57] ABSTRACT

A curtain runner suited for use with a curtain box comprising a body containing a top wall, side walls, and a bottom wall, a sleeve fitted in a vertical bore of the bottom wall, and a rod fitted in the center hole of the sleeve. The sleeve is formed with top and bottom flanges which are larger than the vertical bore. The walls form a hollow space or chamber which is longer than the sleeve and has an upper portion which is wider than the lower portion, the width of which is slightly larger than the diameter of the top flange. The rod is formed with at least one knob at the top end thereof and a curtain-joint at the bottom end thereof. The center hole has the top portion smaller than the knob and another portion larger than the knob. The sleeve is formed with a plurality of upper and lower radial splits for expanding the top portion wider than the knob and contracting the bottom flange smaller than the vertical bore.

4 Claims, 9 Drawing Figures

CURTAIN RUNNER

BACKGROUND AND SUMMARY OF THE INVENTION

The present invention relates to a curtain runner suited for use with a curtain box in which a curtain rail is entirely contained.

A curtain box is used to cover the top portion of a curtain, such as a curtain rail and the curtain runners, and give a nice appearance to the curtain. However, the curtain box prevents easy access except from the bottom and makes it difficult for the curtain cloth to be removed for cleaning and reset on the curtain runners. Another problem is that it is almost impossible to adjust the height of a curtain cloth. Accordingly, there is a demand for a curtain runner which allows a curtain cloth to be vertically adjusted.

It is an object of the present invention to provide a curtain runner enabling a curtain cloth to be easily removed from and fixed to a curtain rail even if it is entirely covered by a curtain box. This is attained by the curtain runner of the present invention comprising a body consisting of top, side, and bottom walls, a pair of wheels mounted on the top wall, and a vertical bore disposed in the bottom wall, a sleeve fitted in the vertical bore and formed with a center hole, said sleeve containing top and bottom flanges provide with a plurality of upper and lower radial splits, and a rod fitted in the center hole of the sleeve and formed with a knob at the top end thereof and a curtain-joint at the bottom end thereof. The walls which form the hollow space or chamber are taller than the sleeve, the upper portion of the hollow space being wider than the lower portion thereof, the width of which being slightly larger than the diameter of the top flange of the sleeve. The center hole of the sleeve has the top portion thereof smaller in diameter than the knob and another portion larger than the same. The splits on the sleeve permit the top portion of the center hole to expand wider than the knob of the rod and the bottom flange to contract narrower than the vertical bore of the body thereby permitting the sleeve to be assembled in the chamber of the body and the rod to be assembled in the sleeve. The rod is easily removed from the sleeve if it is downrightly pulled while the sleeve is raised to have the bottom flange in contact with the bottom wall and reset to the sleeve if it is uprightly inserted into the center hole of the sleeve. This means that a curtain cloth can be easily fixed to the curtain runner contained in a curtain box if the rod is inserted into the sleeve after the curtain cloth has been fixed to the curtain-joint of the rod and that the curtain cloth can be easily removed from the curtain runner within the curtain box if the rod with the curtain cloth is removed from the sleeve.

It is another object of the present invention to provide a curtain runner wherein the curtain cloth is vertically adjustable. The rod is formed with a plurality uniformly spaced knobs, one of which is selected and situated on the top surface of the sleeve to adjust the height of the curtain runner with the result that the curtain cloth is vertically adjusted.

Further objects of the present invention will be become apparent from the specification and claims when considered in connection with the accompanying drawings.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
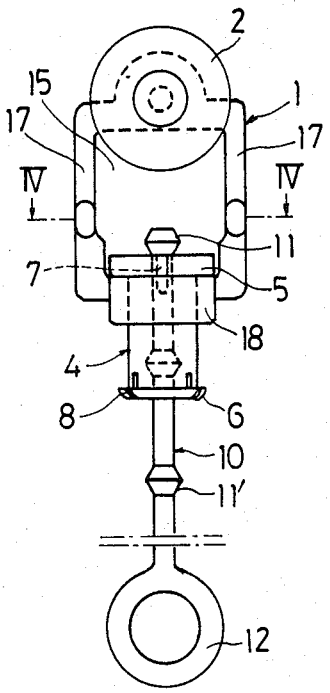
FIG. 1 is a front elevation of the curtain runner of the invention.
Figure 2:
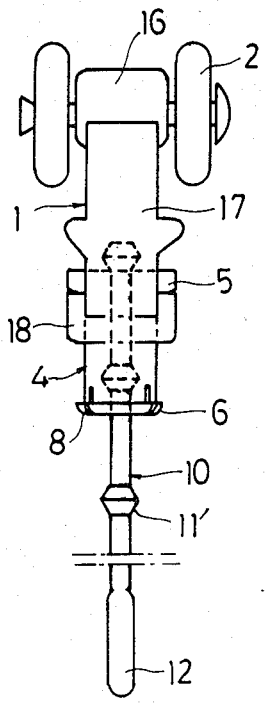
FIG. 2 is a side elevation of the runner.

As seen in FIGS. 1 to 4, the curtain runner of the invention has a body 1 in the form of a box-like frame having a top, side walls, and a bottom wall 16, 17, 18 forming a hollow space or chamber 15, a pair of front and rear wheels 2 mounted in the middle of the top wall 16, a sleeve 4 fitted in the vertical bore 3 in the center of the bottom wall 18, and a rod 10 fitted in the center hole 19 of the sleeve 4. The sleeve 4 is formed with a plurality of upper and lower radial splits 7, 8 and top and bottom flanges 5, 6, which are larger in diameter than the vertical bore 3. The chamber 15 has the upper portion thereof wider than the lower portion, the width of which is slightly larger than the diameter of the bottom flange 8. The rod 10 is formed with a top knob 11 and two intermediate knobs 11' uniformly spaced from each other. The center hole 19 has its top portion 9 tapering to the top opening, which is smaller than the knobs 11, 11'. The other portion than the top portion 9 of the center hole 19 is larger in diameter than the knobs 11, 11'. The rod 10 is formed at the bottom end thereof with a curtain-joint 12 in the form of a ring, to which a curtain cloth is attached.

Figure 5:
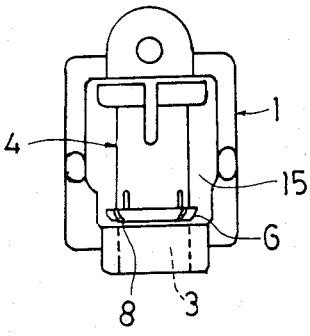
FIGS. 5 and 6 are front elevations, illustrating the successive operational positions in which the body and the sleeve are set up.
Figure 6:
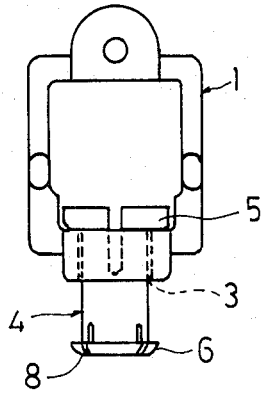

As seen in FIG. 5, before the wheels are mounted on the body 1, the sleeve 4 is placed within the hollow space or chamber 15 of the body 1 and then pushed down into the vertical bore 3 to cause the bottom flange 6 with splits 8 to contract narrower than and pass through the vertical bore 3. When it is fitted in the vertical bore of the body 1, the sleeve 4 has its top flange 5 supported by the upper edge of the vertical bore 3 and the bottom flange 6 with splits 8 expanded as before, as seen in FIG. 6.

Figure 7:
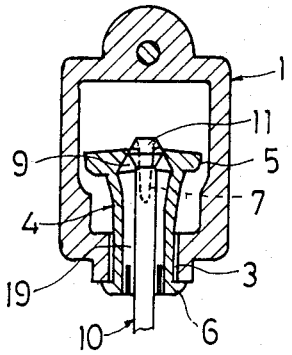
FIG. 7 is a front elevation, illustrating the operational position in which the rod is inserted into the sleeve.

Thereafter, the rod 10 is firstly inserted into the center hole 19 of sleeve 4 from the bottom thereof until the top knob 11 reaches the tapered top portion 9 to raise the sleeve 4 in a position in which the bottom flange 6 abuts the bottom surface of the body 1, as seen in FIG. 7. The rod 10 is then pushed up to cause the top knob 11 to enlarge the portion 9 or top flange 5 with the splits 7 and pass through the top opening of the sleeve 4, resulting in that the sleeve 4 falls to a position as seen in FIGS. 1 to 4. Thereafter, the wheels are mounted on the top wall of the body. It will be understood that the body 1, the sleeve 4, and the rod 10 are easily disassembled from and reassembled to a complete curtain runner.

Figure 3:
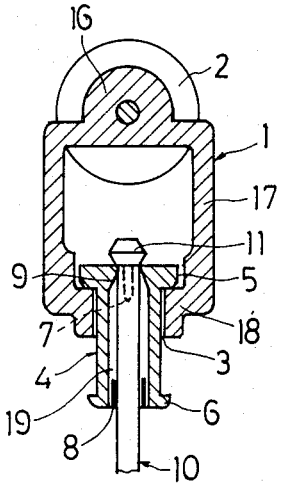
FIG. 3 is a centrally vertical section of the runner.
Figure 4:
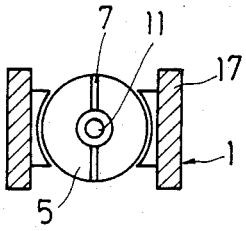
FIG. 4 is a section taken along IV—IV line of FIG. 1.

As seen in FIG. 3, the top knob 11 of the rod 10, supported by the upper surface of the sleeve 4 cannot slip down out of the top opening of the sleeve 4 whenever the top flange 5 locates on the bottom wall 18, because the both side walls 17 of the body 1 prevent the top flange 5 from expanding and permitting the knob 11 to pass through the top opening. If the rod 10 is pulled down when the sleeve 4 is raised up, the top knob 11 can slip off through the top flange 5 with splits 7 and slip down through the top portion 9.

Figure 8:
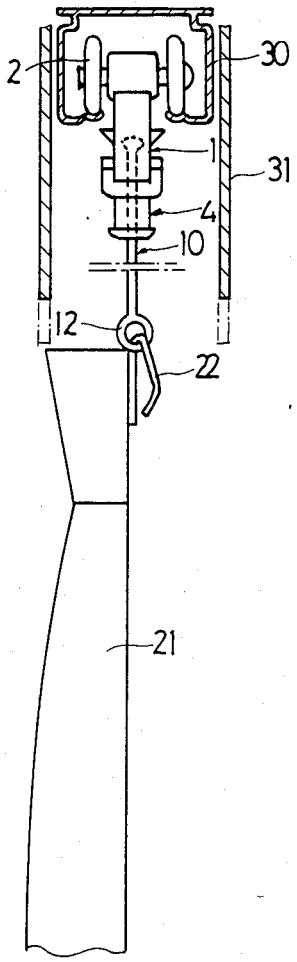
FIG. 8 is a side elevation of a curtain attached to the curtain runner of the invention.

As seen in FIG. 8 illustrating the curtain runner in use, the rod 10 has its curtain-joint 12 in the form of a ring hooked by the respective short hook 22 attached to the curtain cloth 21. The body 1 has a pair of wheels 2 running along the curtain rail 30. It is easy to fix the curtain cloth 21 to the curtain-joint 12 with the short hook 22, which permits the curtain cloth 21 to be removed with ease from the curtain-joint 12 for cleaning.

In the case that the curtain box 31 extends down to a position similar to or lower than the curtain-joint 12 as shown by the dotted lines in FIG. 8, it is difficult to fit the hook 22 in the curtain-joint 12 within the curtain box 31, so that the rod 10 is coupled with the sleeve 4 after the hook 22 has been fitted in the curtain joint outside the curtain box. It is easy to raise the sleeve 4 and then pull down the rod 10 from the sleeve 4, because the curtain box 31 does not prevent upright access to the inside from the bottom. The rod 10 is inserted into and coupled with the sleeve 4 again after it has its curtain-joint 12 attached to the hook 22.

One of uniformly spaced knobs 11, 11' is selected and mounted on the top surface of the sleeve 4 to adjust the height of the curtain 21, the portion of the rod 10 above the selected knob being bent over or removed. If the curtain cloth is hung at a position slightly lower than the curtain rail, the lowest knob is to be selected.

Figure 9:
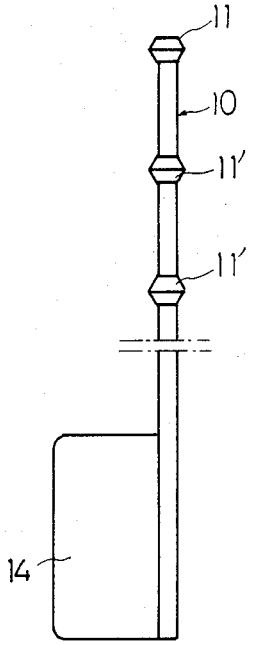
FIG. 9 is another embodiment of the rod.

The rod 10 of another embodiment as shown in FIG. 9 has its curtain-joint 14 in the form of a thin plate to which the upper edge of the curtain cloth is directly attached. The rod is uprightly inserted into and coupled with the sleeve of the curtain runner after the curtain cloth has been attached to the curtain-joint 14. One of knobs 11, 11' is selected to adjust the rod 10 in accordance with the height of the curtain box or curtain cloth.

It will be understood that the rod of invention is long but proves no obstacle to hooking, opening and closing the curtain, because of being easily rotatable relative of the body with the intervention of the sleeve, and that the rod is easily set on and removed from the sleeve fitted in the body after the body has been mounted within the curtain rail.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A curtain runner comprising a body consisting of a top wall, side walls, and a bottom wall which define a chamber, said top wall being provided with roller means, and said bottom wall being formed with a vertical bore, a sleeve fitted in said vertical bore and formed with a center hole, said sleeve having top and bottom flanges which are larger than said vertical bore, and a rod fitted in said center hole in said sleeve and formed with at least one knob at the top end thereof and a curtain-joint at the bottom end thereof, said chamber being larger than said sleeve and having a width of an upper portion thereof larger than a lower portion thereof and where the width of the lower portion is slightly larger than the diameter of said top flange, said center hole having the top portion thereof smaller than said knob and the other portion larger than said knob, and the upper and lower walls of said sleeve being provided with a plurality of radial splits which expand said top portion of said center hole wider than said knob and contract said bottom flange smaller than said vertical bore, whereby the sleeve is mounted through the chamber by causing the bottom flange with the radial splits to compress and pass through the vertical bore, and the rod is coupled with said sleeve by inserting it from the bottom into the center hole of the sleeve causing the top knob to expand the radial splits of the top flange.

2. A curtain runner as claimed in claim 1, wherein said rod is formed with a plurality of uniformly spaced knobs.

3. The curtain runner as claimed in claim 1, wherein said rod is provided at the bottom end thereof with a ring member which functions as a curtain-joint.

4. The curtain runner as claimed in claim 1, wherein said rod is provided at the bottom end thereof with a thin plate member which functions as a curtain-joint.

* * * * *